US010584019B2

(12) United States Patent
Jaatinen et al.

(10) Patent No.: US 10,584,019 B2
(45) Date of Patent: Mar. 10, 2020

(54) ROPE DRUM SYSTEM

(71) Applicant: KONECRANES GLOBAL OY, Hyvinkää (FI)

(72) Inventors: Ollipekka Jaatinen, Hyvinkää (FI); Adeyinka Abass, Hyvinkää (FI); Johannes Grönroos, Hyvinkää (FI); Atte Lähteenmäki, Hyvinkää (FI); Matti Pajula, Hyvinkää (FI); Jesse Parviainen, Hyvinkää (FI)

(73) Assignee: KONECRANES GLOBAL OY, Hyvinkaa (FI)

( * ) Notice: Subject to any disclaimer, the term of this patent is extended or adjusted under 35 U.S.C. 154(b) by 155 days.

(21) Appl. No.: 15/575,575

(22) PCT Filed: May 18, 2016

(86) PCT No.: PCT/FI2016/050333
§ 371 (c)(1),
(2) Date: Nov. 20, 2017

(87) PCT Pub. No.: WO2016/185093
PCT Pub. Date: Nov. 24, 2016

(65) Prior Publication Data

US 2018/0127248 A1 May 10, 2018

(30) Foreign Application Priority Data

May 20, 2015 (FI) ..... 20155369

(51) Int. Cl.
*B66D 1/76* (2006.01)
*B66D 1/74* (2006.01)

(52) U.S. Cl.
CPC ..... *B66D 1/76* (2013.01); *B66D 1/741* (2013.01); *B66D 1/7447* (2013.01)

(58) Field of Classification Search
CPC ..... B66D 1/38; B66D 1/741; B66D 1/7447; B66D 1/76
See application file for complete search history.

(56) References Cited

U.S. PATENT DOCUMENTS 2,428,703 A * 10/1947 Ewing ..... B65H 51/22 242/366
2,576,233 A * 11/1951 Lorig ..... B05C 3/12 242/364.1

(Continued)

FOREIGN PATENT DOCUMENTS

CN 1126171 A 7/1996
CN 2776947 Y 5/2006

(Continued)

OTHER PUBLICATIONS

First Search Report received for Chinese Application No. 2016800292929, dated Sep. 27, 2018, 5 pages including 2 pages of machine Translation.

(Continued)

*Primary Examiner* — Emmanuel M Marcelo
(74) *Attorney, Agent, or Firm* — Ziegler IP Law Group, LLC

(57) ABSTRACT

A rope drum for drawing and releasing a rope under tensile stress. Support segments are arranged to provide a number of grip sections for supporting the rope through the grip sections as a continuous spiral surrounding the rotated drum part by at least two rounds so that, when the drum part is rotated, a number of grip sections move due to the guidance of the support segments along the drum part depending on the rotation direction of the drum part towards the first end of the drum part or towards the second end. Prevention grooves or ridges together with the support segments restrict the movement of the grip sections supporting the rope on the drum part with regard to the drum part in the direction of the (Continued)

perimeter to a maximum that is defined by the mutual geometry of the prevention grooves or ridges and the support means.

20 Claims, 6 Drawing Sheets

(56) References Cited

U.S. PATENT DOCUMENTS

| | | | | | |
|---|---|---|---|---|---|
| 2,798,593 | A * | 7/1957 | Lowe | D01D 10/0436 | 242/364.4 |
| 2,836,983 | A | 6/1958 | Stewart | | |
| 3,258,247 | A * | 6/1966 | Jones, Jr. | B66D 1/76 | 242/366.2 |
| 3,329,406 | A | 7/1967 | Flair | | |
| 3,728,987 | A * | 4/1973 | Kronseder | B65C 9/20 | 118/62 |
| 4,440,353 | A * | 4/1984 | Shelton | B65H 51/22 | 242/131 |
| 4,676,483 | A | 6/1987 | Magill | | |
| 6,471,190 | B2 * | 10/2002 | Lindeman | B66D 1/7447 | 254/371 |
| 7,055,805 | B1 * | 6/2006 | Leitch | B66D 1/7421 | 254/371 |
| 2006/0022182 | A1 | 2/2006 | Blanc | | |
| 2014/0311323 | A1 * | 10/2014 | Erlendsson | D07B 1/025 | 87/6 |

FOREIGN PATENT DOCUMENTS

| | | | |
|---|---|---|---|
| DE | 2006001322 | U1 | 5/2007 |
| EP | 0699618 | A1 | 3/1996 |
| EP | 2185464 | A1 | 5/2010 |
| GB | 329708 | A | 5/1930 |
| GB | 365021 | A | 1/1932 |
| GB | 775511 | A | 5/1957 |
| GB | 1508963 | A | 4/1978 |
| GB | 1566904 | A | 5/1980 |
| GB | 2254855 | A | 10/1992 |
| JP | H09-255287 | A | 9/1997 |
| WO | 9209831 | A1 | 6/1992 |
| WO | 2013144819 | A1 | 10/2013 |
| WO | 2014174541 | A1 | 10/2014 |

OTHER PUBLICATIONS

International Search Report, Application No. PCT/FI2016/050333/ dated Aug. 16, 2016, 7 pages.

Finland Search Report, Application No. 20155369, dated Jan. 8, 2016, 2 pages.

Finland Office Action, Application No. 20155369, dated Mar. 24, 2017, 4 pages.

International Preliminary Report on Patentability, Application No. PCT/FI2016/050333, dated Sep. 11, 2017, 26 pages.

Written Opinion of the International Searching Authority, Application No. PCT/FI2016/050333, dated Aug. 16, 2016, 6 pages.

* cited by examiner

ROPE DRUM SYSTEM

TECHNICAL FIELD

The aspects of the disclosed embodiments are related to a rope drum system.

BACKGROUND

A rope drum is used, for example, in cranes for drawing and storing a hoist rope. In a normal hoisting device, the hoist rope is wound on a rope drum on one or several layers so that the lifted part of the rope is stored on the drum. By winding the rope on more than one layer, the rope drum becomes shorter than when using a rope drum that winds on one layer. A shorter rope drum is naturally more rigid, requires less material and causes less change in the sideward rope angle during winding and, at the same time, reduces the wear of the rope when the sideward movement is reduced, but causes at the same time increased wear of the rope when overlapping layers of the rope are formed. The rope drum may have a rope groove in the form of a spiral where the rope is wound for storage. Due to the single-layered winding, it is also necessary to store and acquire various drums and parts of support for equipment using ropes of different lengths. In multi-layered winding, a longer rope is wound on top of previously wound layers, whereby in the case of a longer rope it is not necessary to change the drum very much. Transmission, instead, either has to be over-dimensioned for equipment using shorter ropes or application-specifically adapted. Namely, when layers increase, the effective radius increases and, accordingly, the transmission ratio between the hoist rope and an engine changes to be more sparsely transmitted. The speed of the rope also changes according to the number of layers on the drum. Thereby, the changing speed of the rope has to be accepted, or the change in the effective radius of the rope drum must be compensated by means of on an engine or gearing. In practice, in even a little more used hoisting devices multi-layer winding is not used, because in a hoisting device of large load, the layers of rope rub against each other and abrade; likewise, the section where the rope rises from one layer to another causes a great strain on the rope. Multi-layer winding is mainly used in mobile cranes by means of which lifting is performed rather rarely, for example, a few times a day.

Instead of a rope drum, a drive wheel has been used in some applications, in the perimeter of which there is one groove for the sideward support of the rope. A number of such drive wheels may be located operationally consecutively so that a desired pulling capacity is achieved. It is not possible to store rope pulled in on a drive wheel. EP 2 185 464 B1 presents an effective solution for the storage of rope pulled in in connection with a drive wheel so that the wound rope does not unnecessarily harm the part of the rope wound on lower layers.

The rope is stretched one percent of its length, for example, depending on the tensile stress. When the rope is wound, the rope slides slightly on the surface of the drive wheel due to the stretching of the rope, and this may cause wear of the rope. Wear is reduced, for example, by lubricating the rope, by using suitably soft lining material on the drive wheel to preserve the rope (e.g. GB 2 254 855 A), or by arranging flexible support between the rope and the drive wheel corresponding to the stretching of the rope in the direction of the perimeter of the drive wheel. Such support that is flexible in the perimeter direction is presented in publications WO 92/09831 A1, US 2006/0022182 A1 and GB 1 508 963.

WO 92/09831 A1 describes a solution where an endless track is formed of intermediate pieces between the drive wheel and the rope, where the intermediate pieces are allowed to slide along the surface of the drive wheel and to prevent the sliding of the rope. In one example in the publication, the drive wheel is simply surrounded by one layer of intermediate pieces joined to each other, which convey the force from the drive wheel to the rope through friction. In another example, an endless chain of intermediate pieces winds two rounds around the drive wheel and a third time for a part of the perimeter of the drive wheel, and then makes a loop under the drive wheel. Thus, it is possible to form contact with a drive wheel through intermediate pieces to the drive wheel at an angle of 720 degrees, i.e. through a length of two rounds. In accordance with this embodiment, the adjacent intermediate pieces slide with regard to both the drive wheel and the adjacent intermediate pieces and the friction that is formed exposes the intermediate pieces to wear and overheating.

US 2006/0022182 A1 describes a winch that is designed to be used with especially valuable synthetic cables or ropes. The examples referred to include electrical and data transfer cables and synthetic ocean exploration ropes that have a small density difference to seawater. The winch has two adjacent drums, which have for each round of the rope a ring formed of elastic material that forms a rope groove forming a full circle. Each ring is allowed to slide on the surface of the drum according to the stretching of the cable. The rings do not form a groove in the form of a spiral for the cable, but the shift from one ring to another is implemented so that, on each ring, the cable is guided for half a round and then the cable is guided to the next ring on the second drum which is half the thickness of the ring further in the axial direction of the drum. Thanks to the two drums, US 2006/0022182 A1 avoids the need to transfer any intermediate pieces outside the drum and the need to create a chain of separate intermediate pieces at all.

GB 1 508 963 describes the pulling equipment of an elevator, which the subsequent US 2006/0022182 A1 resembles. This publication also has two consecutive drums that form tension on a rope through surrounding loops. A groove for the rope is formed by segments that are allowed to move in the direction of the perimeter. The movement in the direction of the perimeter is implemented through flexible radial spools. Thanks to the spools, it is also possible to avoid the problem that the movement in the direction of the perimeter could grow to be unmanageably large if the friction coefficient between the part that slides in the direction of the perimeter and its base were too small—the friction coefficient may not be too large, either, so that the sliding would be implemented and the preservation of the rope could succeed. On the other hand, the publication seems to have common segments or sectors for the adjacent grooves of the rope, which prevents adaptation in the direction of the perimeter in the different grooves in accordance with the stretching of the rope (because the stretching of the rope is not a constant) and exposes the sectors to twisting. The twisting of the sectors may cause a geometrical error that wears the ropes. As in the publication US 2006/0022182 A1, the part of the rope between the drums also hits the edge of the circular grooves at a small angle, because the grooves must be axially slightly to the side from each other.

The aforementioned publications present ways of winding the rope in and out so that the rope angle may stay unchanged and the rope wound in may be stored on a number of layers so that stress does not arise for the layers at the bottom caused by the tension of the rope pulled in. In the publications presented, however, two or more drums or a rope pulley and/or an intermediate piece sliding with regard to the surface pulling in the direction of the perimeter are needed, the management of the friction of which may be difficult. The object of the invention is to avoid or mitigate the disadvantages related to prior art or at least to provide a new technical alternative parallel to prior art.

SUMMARY

In accordance with a first aspect of the invention, a rope drum is provided for drawing and releasing a rope under tensile stress, which rope drum comprises:

a rotatable drum part; for which rope drum the following are characteristic:

support means arranged to provide a number of grip sections for supporting the rope through the grip sections as a continuous spiral surrounding the drum part by at least two rounds so that, when the drum part is rotated, a number of grip sections move along the drum part due to the guidance of the support means depending on the rotation direction of the drum part towards the first end or the second end of the drum part; and prevention means that together with the support means are arranged to restrict the movement of the grip sections supporting the rope on the drum part with regard to the drum part in the direction of the perimeter to a maximum that is defined by the mutual geometry of the prevention means and the support means.

The grip sections supporting the rope on the drum part may support the rope with regard to the drum part at least in the direction of the perimeter. The grip sections supporting the rope on the drum part may support the rope radially against the drum part for only part of the perimeter of the drum part. Alternatively, the grip sections supporting the rope on the drum part may support radially against the drum part at a length of at least one or several whole rounds.

Because the slide of the grip sections in the direction of the perimeter may be restricted to the desired maximum by means of the mutual geometry of the prevention means and the support means, it is possible to control the wear of the prevention means and the support means and to make the support of the rope independent of the friction between the drum part and the support means.

The movement of the grip sections supporting the rope on the drum part in relation to the drum part may be no more than 0%, 1%, 2% or 5% in the direction of the perimeter compared to the axial direction.

The prevention or restriction of the movement of the grip sections in the direction of the perimeter of the drum part with regard to the drum part may prevent or reduce the wear of the support means.

The prevention or restriction of the movement of the grip sections in the direction of the perimeter with regard to the drum part may prevent or reduce the risk that, due to a change in the friction coefficient between the support means and the drum part, it would not be possible to maintain sufficient tension in the rope.

Through the grip sections, it is possible to keep the rope supported in the axial direction of the drum part as a spiral staying in its position. Maintaining the rope supported as a spiral staying in its position may maintain the rope angle unchanged when the rope is pulled in or released out.

The direction of the perimeter refers to the direction of the tangent of the perimeter of the drum part substantially perpendicularly with regard to the rotation axis of the drum part. Significantly perpendicularly may refer to no more than 0, 1, 2, 5 or 10% deviation from the perpendicular.

The axial direction refers to the direction parallel to the rotation axis of the drum part.

The support means may be arranged to provide grip sections for the rope for only part of the length of the drum part.

The support means may comprise a set of guide segments. The support means may comprise a guide for guiding the guide segments on the surface of the rope drum. The support means may comprise a shell surrounding the drum part. The shell may comprise a set of bearing rolls. The bearing rolls may be arranged to form a series of bearing rolls to guide the guide segments by the sides of the guide segments as a spiral along the drum part. The bearing rolls may be located so densely that the guide segments receive a reliable guide surface from the side contact to the bearing rolls on the rope drum. The bearing rolls may be located that densely on the spiral that each guide segment or at least a majority of the guide segments are simultaneously contacted by at least two bearing rolls on one side.

The rope drum may comprise a first bearing at the first end of the rope drum and a second bearing at the second end of the rope drum. The first bearing may be a bearing carrying axial forces. The second bearing may be a bearing carrying radial forces. The second bearing may be a floating bearing.

The rope drum may comprise a linking of the guide segments. The linking of the guide segments may comprise links that connect the consecutive guide segments operationally separately to each other. Alternatively, the linking of the guide segments may comprise a link connecting several guide segments, with regard to which the guide segments are arranged to settle separately from each other by means of flexible separators. The linking connecting several guide segments may comprise a tie threaded through channels leading through a number of guide segments. The tie may comprise a wire and and/or a string. The flexible separators may comprise springs, magnets, elastically compressible polymer pieces, and/or gel bags. The linking of the guide segments may comprise a guide segment that is adapted for the adjustment of the length of the tie. The adjustment segment adapted for the adjustment of the length of the tie may comprise a tie lock for locking the tie at a desired location on the adjustment segment. The tie lock may comprise a screw, a wedge, a lock pin and/or a soldered joint.

In accordance with a second aspect of the invention, a method is provided for drawing and releasing a rope under tensile stress by means of a rope drum, for which it is characteristic that:

supporting the rope through a number of grip sections as a continuous spiral surrounding the drum part by at least two rounds so that, when the drum part is rotated, a number of grip sections move along the drum part depending on the rotation direction of the drum part towards the first end of the drum part or the second end; and restricting the movement of the grip sections supporting the rope on the drum part with regard to the drum part in the direction of the perimeter to a maximum that is defined by the mutual geometry of the prevention means and the support means.

The grip section may refer to a point or part through which the rope is supported on the drum part and the tension of the rope is conveyed to the drum part. The grip sections may be formed of separate parts or inseparable portions.

In accordance with a third aspect of the invention, an apparatus is provided for drawing and releasing a rope under tensile stress by means of a rope drum, for which the following are characteristic:

- means for supporting the rope as a continuous spiral surrounding the drum part by at least two rounds through a number of grip sections so that, when the drum part is rotated, each grip section moves in the direction of the rotation axis of the drum part along the drum part to keep the spiral in place, and
- means for preventing the movement of each grip section with regard to the drum part in the direction of the perimeter of the drum part.

In accordance with a fourth aspect of the invention, a guide segment is provided for a rope drum in accordance with any aspect of the invention, for which guide segments the following are characteristic:

- a base arranged to settle against the drum part;
- a form locking part for locking the guide segment with regard to the surface of the drum part in the direction of the perimeter of the drum part; and
- a rope groove part opposite to the base, which is arranged to receive a part of the rope and convey tensile stress from the part received through the guide segment via the form locking part to the drum part.

Different embodiments of the present invention will be described or are described only in connection with some or several aspects of the invention. A person skilled in the art understands that any embodiment of an aspect of the invention may be applied in the same aspect of the invention and in other aspects alone or in combination with other embodiments.

BRIEF DESCRIPTION OF THE FIGURES

The disclosed embodiments will now be described by way of examples with reference to the adjacent drawings, where.

DETAILED DESCRIPTION

Figure 1:
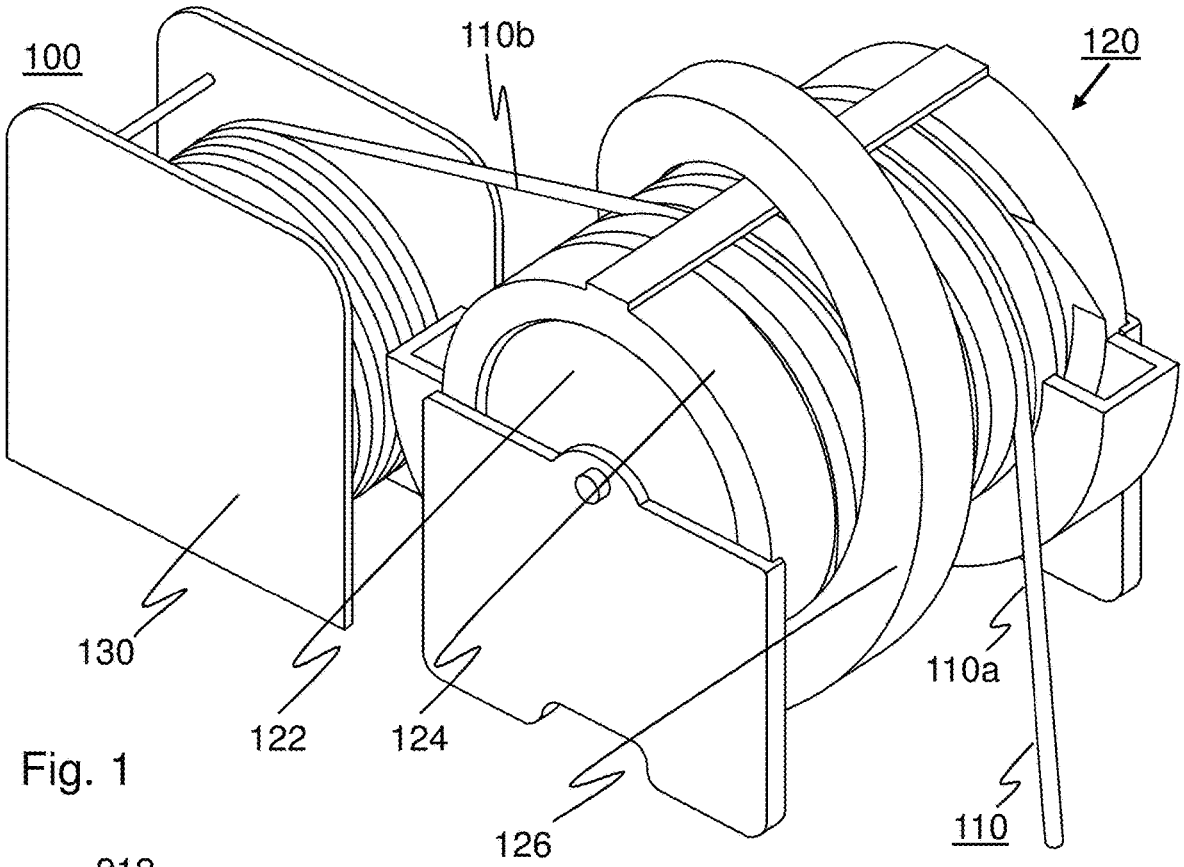
FIG. 1 presents equipment in accordance with an embodiment of the present disclosure.

In the following detailed description, like reference signs refer to like parts of phases. It should be noted that the Figures presented are not on scale as a whole, and that they mainly serve the purpose of illustrating embodiments of the present disclosure.

To facilitate understanding the embodiments described in more detail, let it be noted that, in accordance with an embodiment, a rope drum 120 (FIG. 1) is provided for drawing and releasing a rope 110 under tensile stress, which rope drum comprises:

- a rotatable drum part 122;
- support means (for example, guide segments 220, FIG. 4; for example, a guide 124), which are arranged to provide a number of grip sections (a rope groove 512 in FIG. 5) for supporting the rope through the grip sections as a continuous spiral surrounding the drum part 122 by at least two rounds (see 310 in FIG. 3 and FIG. 1) so that, when the drum part is rotated, a number of grip sections move due to the guidance of the support means depending on the direction of rotation of the drum part towards the first end of the drum part (320) or the second end (330); and
- prevention means (for example, a groove 210 functioning as a first support in FIG. 2*b* and a protruding part 514 of a guide segment 220 in FIG. 5), which together with the support means are arranged to restrict in the perimeter direction the movement of the grip sections that support the rope on the drum part in relation to the drum part to a maximum determined by the prevention means and the support means compared to the axial direction.

The aforementioned embodiment illustrates how certain details presented in different Figures may be related to each other. We may contemplate in the light of FIGS. 2*a* and 3, for example, that the guide groove 310 and the slightly twisting grooves in the drum achieve that the guide segments 220 proceed along the guide groove 310 on the surface of the drum part within the guide along the spiral determined by the guide groove and at the same time slide along the drum part groove, i.e. the first support 210. When sliding in the groove, the guide segments proceed mainly axially, i.e. in the direction of the rotation axis of the drum part so that the slight twist of the drum part causes a small (e.g. less than 10%) rise or fall in the direction of the perimeter.

FIG. 1 presents equipment 100 in accordance with an embodiment of the invention. The equipment 100 comprises a rope 110, a part 110*a* of which is strained by a weight (not presented) and kept under tensile stress and, as necessary, drawn or released by the rope drum 120. The rope drum comprises the drum part 122, the guide 124 and a returning device 126. In this document, the drum part 122 is referred to when it is specifically necessary to refer to the drum part 122 rotating within the guide 124. The equipment 100 also comprises a storage drum 130 functioning as rope storage, which receives rope 100 from the rope drum 120 through a free part 110*b*.

Figure 2A:
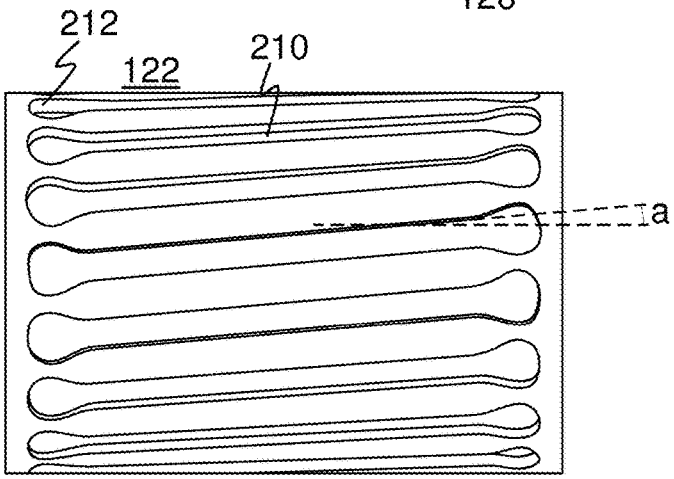
FIGS. 2*a*-2*b* present a drum part in accordance with an embodiment of the present disclosure.

FIG. 2*a* presents the drum part 122 in accordance with an embodiment of the invention. FIG. 2*a* shows drum part grooves formed in the drum part 122, which extend across the middle section of the drum part used for the tensioning of the rope in the direction of the rotation axis of the drum part. The grooves form one part of the aforementioned first supports. In accordance with an embodiment, the drum part 122 is generally formed as an annular cylinder. In accordance with an alternative embodiment, the drum part is conical, positively cambered, i.e. barrel-shaped, or negatively cambered, i.e. growing by its radiuses towards its ends.

In accordance with an embodiment, the prevention means comprise a number of substantially axial first supports separately from each other in the direction of the perimeter of a shell, such as, for example, grooves formed on the outer surface of the drum part 122. The first supports are, for example, equidistant from each other, for example, so that the distance of the centerlines from each other is substantially constant when measured along the perimeter of the drum part 122. In accordance with an embodiment, the first supports comprise, in addition to or instead of grooves, ridges or ribs formed on the outer surface of the drum part. The first supports may be in the direction of the rotation axis of the drum part 122. Alternatively, the first supports may deviate from the rotation axis of the drum part by a deviation angle $\alpha$. The deviation angle may be in degrees (when the full circle is 360 degrees) no more than 1°, 2°, 3°, 4°, 5°, 6°, 7°, 8°, 9° or 10°. The deviation angle may be at least 0.1°, 1°, 2°, 3°, 4°, 5°, 6°, 7°, 8°, 9° or 10°. The deviation angle may form a force component formed by the tension of the rope in the direction of the rotation axis of the drum part. The force component may facilitate the sliding of spiral-forming parts of the rope along the drum part to maintain the place of the spiral, when the drum part is rotated in the direction where a load is drawn by the rope towards the rope drum. In this document, drawing the rope towards the rope drum may refer to the drawing of the rope part 110*a* on the side of the load towards the rope drum.

In accordance with an embodiment, the angle $\alpha$ may change in the different parts of the rope drum. The angle alpha may be as if uphill or downhill depending on on which side the load is supported by the rope. The direction thus has an impact on whether the mechanism proceeds easily when the load is lifted and lowered. It also has an impact on self-locking. In an embodiment, the angle alpha is 0 degrees on the first ¾ rounds, after which the rope can be released from the supports with a sheave, so that they can on the following ¼ rounds proceed at a larger angle $\alpha$. During the second round, the rope may correspondingly be partly at an angle of $\alpha=0$ and again with a separate sheave the rope and the supports are transferred to a necessary location for the following round. In this way, the wear between the supports and the drum is reduced, because there is no axial movement under the pressure of the rope, or at least the axial movement is substantially smaller. The force directed at the supports may thus be reduced exponentially, i.e. by one or several portions supported against the rope drum arranged at an angle of $\alpha=0$ it is possible to substantially reduce the wear of the supports.

The direction of the perimeter of the drum part may refer to the tangential direction of the perimeter of the drum part substantially perpendicularly with regard to the rotation axis of the drum part. In accordance with an embodiment, the prevention means are arranged to prevent the movement of each grip section in the direction of the perimeter of the drum part along the drum part.

Figure 2B:
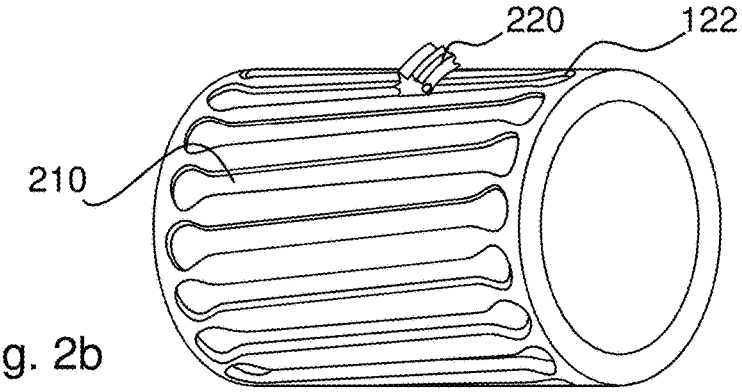

FIG. 2*b* presents a drum part 122 and one guide segment 220 on the surface of the drum part. In accordance with an embodiment, the prevention means further comprise first supports matching second supports formed at the base of the guide segments 220, arranged to guide the rope on the drum part as a spiral, such as protruding parts 514 presented in FIG. 5.

In the embodiment of FIG. 1, the rope turns around a spiral that is fixedly located with regard to the rope drum 122, where the guide segments 220 form a substantially uniform base between the rope 110 and the drum part 122. In other words, the guide segments 220 can be arranged to settle against the outer surface of the drum part. The guide segments 220 can be arranged to convey compressive force from the rope 110 to the drum part 122.

In the embodiment of FIG. 1, the rope is supported as a continuous spiral surrounding the drum part. In other words, the rope is not led away from the drum part to turn around another drum or rope pulley, for example. The spiral may have a substantially constant radius, i.e. the shortest distance to the rotation axis of the drum part. When the rope drum rotates, the spiral is formed by a changing part of the rope, but the spiral formed by the rope turning around the rope drum stays substantially in place.

Referring to FIGS. 2*a* and 2*b*, the first supports may be formed to function as part of the prevention means only after the guide segment 220 has settled on the drum part after the start section of the spiral, for example, after the length of 0.1; 0.2; 0.3; 0.4; 0.5; 0.6; 0.7; 0.8; 0.9; or 1.0 rounds of the drum part. In this way, the wear of the guide segments may be reduced. FIG. 2*a* shows extensions 212 at the end of the grooves, due to which the guide segment 220 arriving at the drum part from the returning device 126 may settle on the drum part 122. The guide segment may also be fully flat at its base to achieve a maximal wearing surface. The drum may then support the guide segment at its frontal surface. The part protruding due to the extensions 212 or, simply put, a peg 514 may settle in the radial direction of the drum part as far as the peg 514 can move down before the side of the peg 514 meets the side of the groove and prevents the movement of the guide segment in the direction of the perimeter of the drum part 122. At the extension, the groove is preferably wider than the guide segment 220 in the direction of the perimeter of the drum part 122. In accordance with an embodiment, the ends of the grooves have, in addition to or instead of the extensions 212, beveled edges to facilitate the receipt of the peg 514.

In accordance with an embodiment, the guide segments 220 are arranged to receive a load from the rope 110 in the direction of the perimeter of the drum part and to distribute this load in the direction of the load to the next guide segments. By distributing the load, the wear of the guide segments can be reduced.

In accordance with an embodiment, the guide segments 220 are arranged to form a rigid entirety larger than the perimeter of the drum part, which is radially pressed against the drum part only at its upper part.

Figure 6:
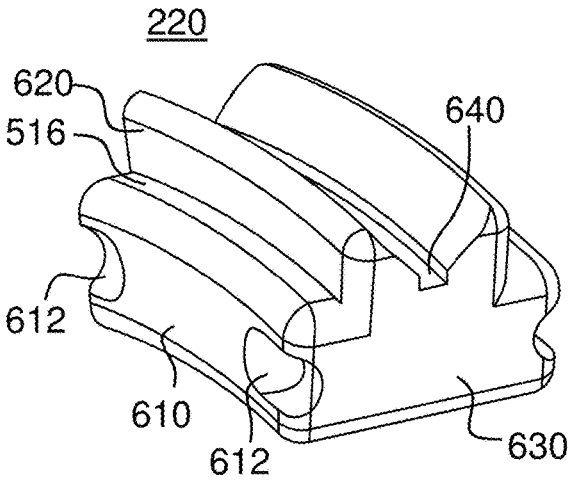
FIGS. 6-8 present views of a guide segment in accordance with an embodiment of the present disclosure from different directions.
Figure 7:
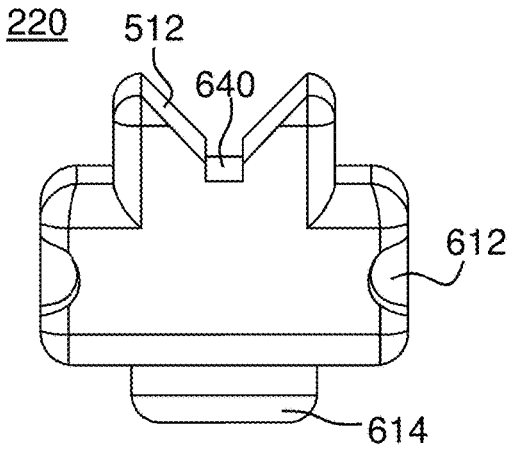

In accordance with an embodiment, the guide segments form a rope groove 512 (FIGS. 5-7) to receive the rope and to grip the rope through friction. The rope groove may be, for example, wedge-like, semicircular, or elliptic. The rope groove may be asymmetric as to its cross-section. At the bottom of the rope groove there may be a base groove 640 (FIGS. 6, 7). The base groove may have straight sides. The base groove may be asymmetric.

In accordance with an embodiment, the guide segments 220 comprise at their other side a first form locking part 514 presented previously as a peg. The first form locking part may comprise a protruding part, such as a peg or a rib. The protruding part may be round, oval, or oblong as to its cross-section. The head of the protruding part may be rounded. The head of the protruding part may be shaped as a spherical calotte. The protruding part may formed as a spherical calotte. The protruding part may be in the middle with regard to the guide segment settled on the drum part at least in one of the following directions: in the direction of the axis of the drum part; and in the direction of the perimeter of the drum part. Alternatively, if the first supports are protruding, the first form locking part may be a corresponding recess.

In accordance with an embodiment, the first form locking part 514 of the guide segment 220 and the first support 210 of the drum part 122 are formed so that the first form locking part conveys to the first support 210 of the drum part 122 part of the force caused by the rope through the guide segment 220 against the drum part 122. In this way, it is possible to even out the carrying of the radial force in the guide segment 220 and use better wear-resisting (even more fragile) material and/or structure in the guide segment. Alternatively, the first form locking part 514 and the first support 210 are formed so that the first form locking part does not substantially convey the force caused by the rope to the first support 210 of the drum part 122 through the guide segment 220 against the drum part 122. For example, the protruding peg functioning as the first form locking part may be shorter than the width of the groove functioning as the first support. In this way, it is possible to reduce the wear of the first form locking part and/or the first support.

In accordance with an embodiment, the end of the guide segment 220 forms a form locking part that engages with a ridge protruding from the drum part 122. The ridges of the drum part may separate the guide segments apart from each other and carry the rope between the guide segments. In such an embodiment, it is possible to select the desired distribution of load by the selection of the width of the ridges and the lengths of the guide segments 220 through the ridges to the drum part and the implementation of the sliding caused by the lateral transfer of the rope through the guide segments 220. By means of the guide segments 220 and the guide 124 the rope can, however, be kept in place as a spiral with regard to the rope drum, even though on part of the spiral there are no guide segments between the rope and the rope drum. The end of the guide segment 220 may be beveled in accordance with the angle of ascent of the spiral, for example.

The form locking parts may be formed so that they form in the loaded guide segment 220 a force pressing against the drum. For example, the end of the guide segment or the side of the peg may be beveled to bite tighter at the prevention means of the drum part when under pressure.

Figure 12:
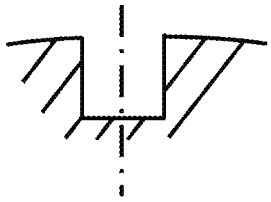
FIGS. 12-15 present different profiles of rope drum grooves.
Figure 13:
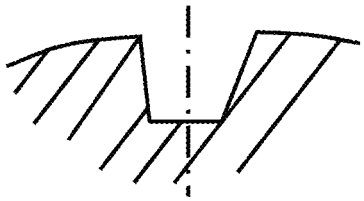
Figure 14:
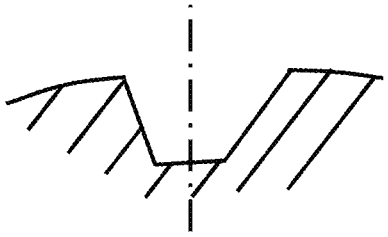
Figure 15:
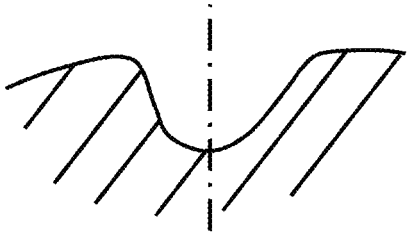

In accordance with an embodiment, the groove is asymmetric in its lengthwise direction, i.e. the symmetry axis of the groove is a straight line in the direction of the radial penetrating the drum part 122 in the center. FIG. 12 presents a simple oblong-shaped groove profile. FIG. 13 presents a trapezoidal groove profile. The other side of the groove may be in the direction of the radius and the other side slightly tilted so that the groove narrows down towards the base. FIG. 14 presents a groove profile where both sides of the groove are tilted at deviating inclinations. The groove may have curved walls. One side of the groove may join the base of the groove at a larger radius of curvature than the other side of the groove, as presented in FIG. 15, for example. One side of the groove may be straight and the other side curved. One side of the groove is preferably steeper on the side at which the rope's carrying force is directed. There may also be a shoulder, a groove, or other forms on the side of the groove when desiring, for example, form locking, suitable evening out of the distribution of the load over the different parts of the groove, optimization of lubrication, wear resistance, or other desired characteristics. There may be a recess on the side of the groove, the inclination of the surface or form of which may influence the guide segment due to the force of the rope so that the guide segment tends to be pressed deeper towards the smaller radius of the rope drum. The base of the groove may be curved or straight. The base of the groove may be tilted so that it deviates from the tangent drawn on the base of the groove of the rope drum.

Figure 8:
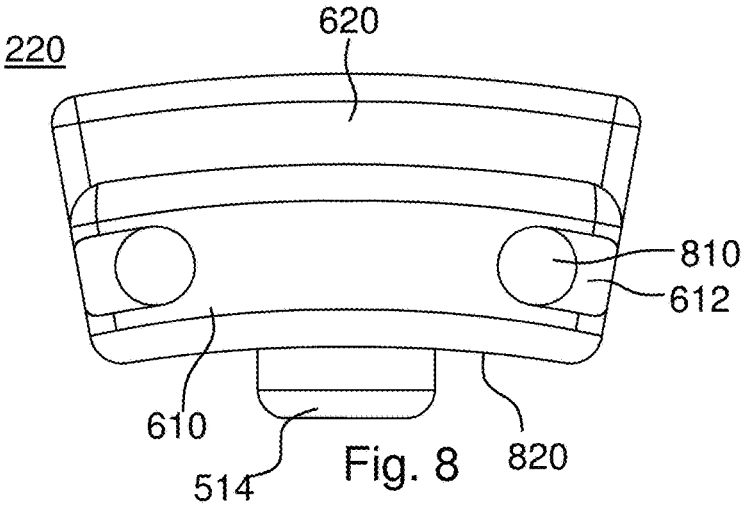

In accordance with an embodiment, the guide segment 220 matches the form of the perimeter of the drum part 122 so that it has a concave surface 820, from which it settles on the perimeter of the drum part 122, see FIG. 8.

The guide segments may consist of one or several materials. The first form locking part 514 of a guide segment may be of a different material than the base of the rope groove. In an embodiment, the base of the rope groove comprises rubber, polyurethane or steel. In an embodiment, the first form locking part is of steel. In an embodiment, the different parts of the guide segment are in different ways of the same material processed in different ways, for example hardened or coated in different ways.

In accordance with an embodiment, the guide segments are formed to be linked as a chain. The chain may comprise flexible links between the consecutive guide segments 220. For this purpose, the guide segments 220 can be equipped with link connection means. For example, it is possible to form holes 810 in the guide segments 220 visible in FIG. 8 that extend through the guide segments (crosswise with regard to the direction of the rope groove 512). The links can be protected against wear by sinking the holes 810 in recesses 612 extending to the ends of the guide segments 630.

The links may be formed of an elastic material, such as rubber, synthetic rubber, or elastic polymer. The links may comprise springs. The links may comprise magnets. The flexible links may be formed jointly for two or several of the joints of guide segments. For the purpose of joining a number of guide segments, the guide segments may comprise tunnels between the ends that substantially extend through the guide segments to form a joint link (see FIG. 17). The tunnels may be substantially in the direction of the perimeter or, for example, in the direction of the angle of the spiral formed by the guide segments (e.g. at an angle of $\alpha=x$ degrees, where x is unequal to zero).

The links may be of an inflexible material. The ends of the guide segments may be formed to allow the turning of the chain from the spiral to the opposite direction to return the guide segments at the opposite end of the spiral.

The chain may be arranged to turn around the rope drum between the rope and the drum part in a first direction, at the first rise and at the first radius in relation to the rotation axis of the drum part. The chain may be arranged between the opposite ends of the spiral in another direction opposite to the first direction, at the second rise and at the second radius in relation to the rotation axis of the drum part. The second rise may be larger than the first rise. The second radius may be larger than the first radius. The chain may be arranged between the opposite ends of the spiral by means of one of several idler sheaves. The link between two guide segments may comprise a spacer plate. The chain may be an unending chain. If the chain is not an unending chain, the additional chain may be stored in a chain storage arranged in connection with both ends of the drum part.

The ends 630 of the guide segments 220 may be formed to restrict the twisting and/or bending of the consecutive guide segments 220 with regard to each other. The restriction may reduce the risk of a blockage being formed.

Figure 9:
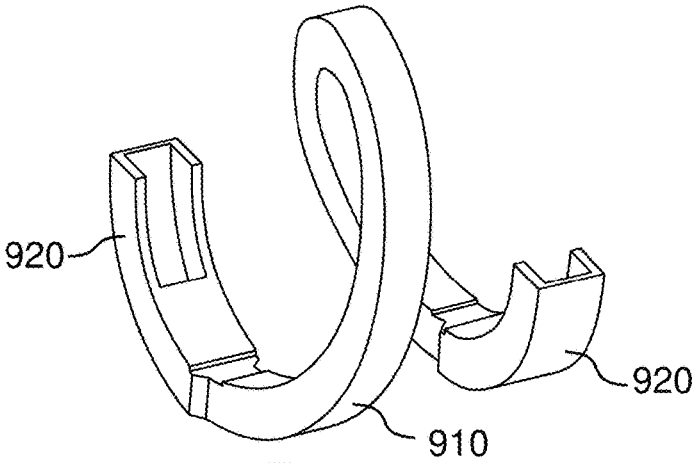
FIG. 9 presents a returning device in accordance with an embodiment of the present disclosure.

The rope drum may comprise a returning device 910 (FIG. 9) for guiding the guide segments between the opposite ends of the spiral. In accordance with an embodiment, the returning device 910 for returning the guide segments turns around the rope drum between the opposite ends of the spiral. The returning device may have externally widening ends 920 to facilitate the entry and release of the guide segments from the drum part 122. Alternatively, the returning device may form a channel for the guide segments where a tolerance of substantially the same size remains around the guide segment throughout the whole length between the different ends of the rope drum. The returning device may be arranged to guide the guide segments between the opposite ends of the spiral, turning once or several times around the drum part. In accordance with an embodiment, the returning device is arranged to join the guide segments to the drum part between each end of the drum part and the respective end of the spiral. The returning device may guide the guide segments as a chain. In accordance with an alternative embodiment, the returning device is arranged to form a return circulation for guide segments that are separate from each other so that the guide segment thrusting to the returning device from one end to the drum part thrusts the guide segments ahead of itself as a return circulation towards the other end of the drum part, and from the returning device one guide segment to the other end of the drum part.

In accordance with an embodiment, the returning device is closed the whole length between the different ends of the drum part. Alternatively, the returning device may be open at least for some part between the different ends of the drum part, for example, for the purpose of checking and/or replacing the chain. In accordance with an embodiment, the chain can be replaced without removing the rope. The old chain can be cut, as necessary, and the new one joined at the end of the old chain, or the new chain can be fed in a throat between the rope and the drum part 122 while the drum part is slowly rotated with sufficient caution and using suitable aids. In accordance with an embodiment, the returning device comprises a lubricating unit for lubricating the guide segments. The lubricating unit may be arranged to lubricate the rope via the guide segments. In accordance with an embodiment, the rope drum comprises lubrication for the first form locking parts of the guide segments. The lubrication may be a dry lubrication.

In accordance with an embodiment, the rope drum comprises a guide 124 for guiding the guide segments to form the said spiral from the rope around the drum part on top of the guide segments. The guide is preferably stationary. In accordance with an embodiment, the guide comprises a shell surrounding the drum part, where a guide groove 310 is formed, which is arranged to guide the guide segments 220 along a desired track (for example, a spiral). The guide groove 310 may broaden outwards at its both ends 314, 316, so that the guide segments are guided more easily into the guide groove.

In accordance with an embodiment, the guide groove does not exist at a part of or throughout the length of the entire rope drum, but the movement of the segments in the direction of the axis is caused by pushing the first segments in the link. In this case, the segments are attached to each other and form a continuous queue, which may be transferred in the direction of the axis just by pushing from the other end.

In accordance with an embodiment, pushing can be achieved by one or several pushers, for example, a rotating wheel to minimize the wear between the pusher and the segment. The rotating wheels may be arranged in a queue so that the queue has substantially the same rise as the rope wound on the rope drum in the case that the rise of the rope drum is a constant. The rotation axes of the wheels are preferably in the directions of the radiuses of the rope drum.

In accordance with an embodiment, the guide groove 310 and the guide segments 220 are formed so that the guide segments 220 can move with regard to the guide in the direction of the guide groove 310 when the drum part 122 is rotating, but cannot rise out of the guide groove 310 in the middle area of the guide groove. For this purpose, the guide segments may have one or several shoulders 516 and in the guide groove a corresponding widening 420, FIG. 5. In this way, it is possible to oppose to the detachment of the guide segment from the surface of the drum part and increase the robustness of the first form locking part 514 of the guide segments by ensuring that the largest possible part of the form locking part 514 stays in contact against the first support of the drum part 122 (e.g. against the side forming the groove). Alternatively, the guide segment may have some other form, for example, a rounding or a bevel instead of or in place of the shoulder.

The side of the guide segments below the shoulder 610 and their upper side 620 may match the corresponding form of the guide groove 310 so that the guide segments receive sideways support from the guide groove from the base of the guide segment up to the ridge of the sides of the rope groove.

Figure 3:
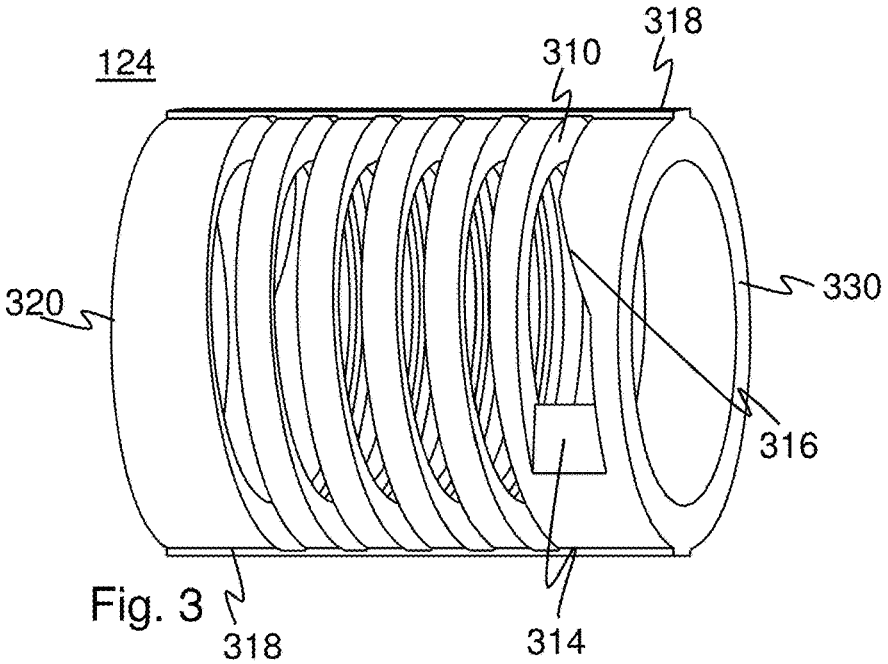
FIG. 3 presents a guide in accordance with an embodiment of the present disclosure.
Figure 4:
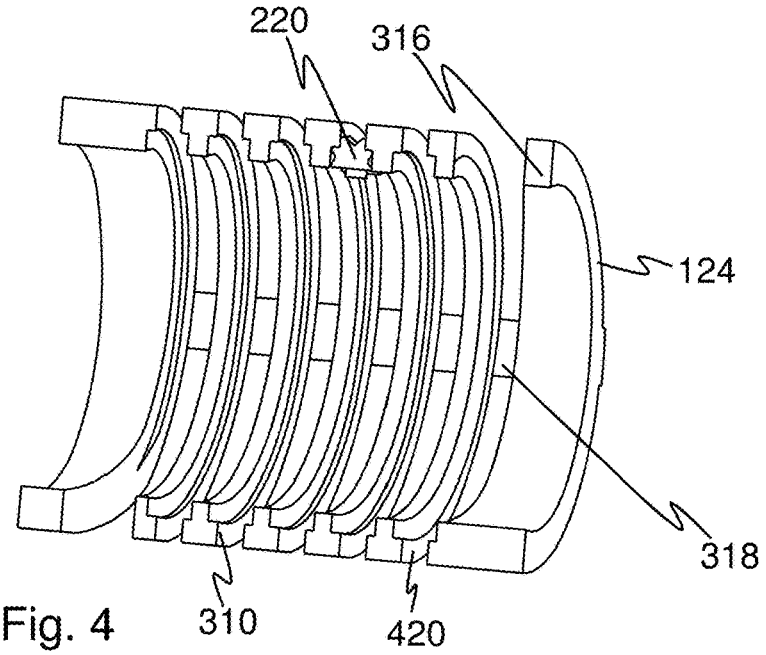
FIG. 4 presents a section of the guide in FIG. 3 seen from the inside.
Figure 5:
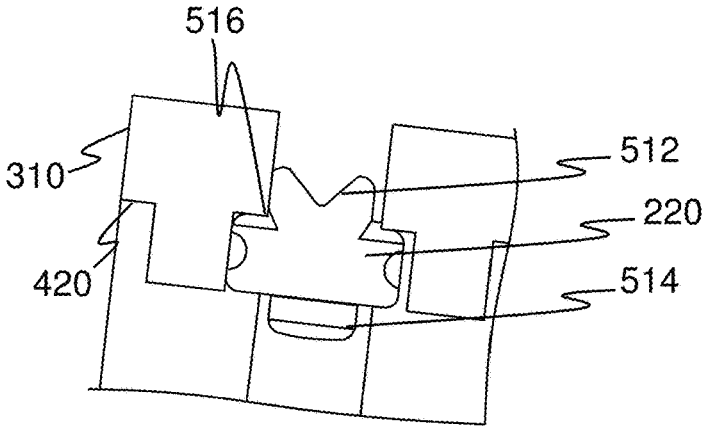
FIG. 5 presents an enlarged detail of the guide in FIG. 3 and a guide segment.

FIGS. 3-5 further show two opposite ties 318 in accordance with an embodiment, keeping hold of the parts 310 forming the spiral.

The rope drum may comprise a cover (not in the Figures) to cover the guide. The cover may have a rope entry hole and a rope exit hole in accordance with the start and end points of the spiral. The cover may be formed of a bent plate, the ends of which are joined by a fastener, such as rivets, screws, or alternatively by welding. The cover may replace the ties 318. The rope drum may comprise an oil bath to lubricate the guide segments and the rope. The oil bath may be formed within the cover of the guide.

The rotation axis of the drum part may be horizontal. Alternatively, the rotation axis of the drum part may be vertical or between the horizontal and vertical directions. A rotation axis that is tilted with regard to the horizontal direction may enable a simple implementation for arranging the oil bath.

In an embodiment of the invention, the guide segments comprise magnets in connection with the frontal surfaces 630 for joining the guide segments to each other. In an embodiment, the guide segments attach magnetically to the drum part on the guide segments' drum part surface to oppose to their detachment. The magnetic attachment may be implemented by magnets in connection with the frontal surfaces.

Figure 10:
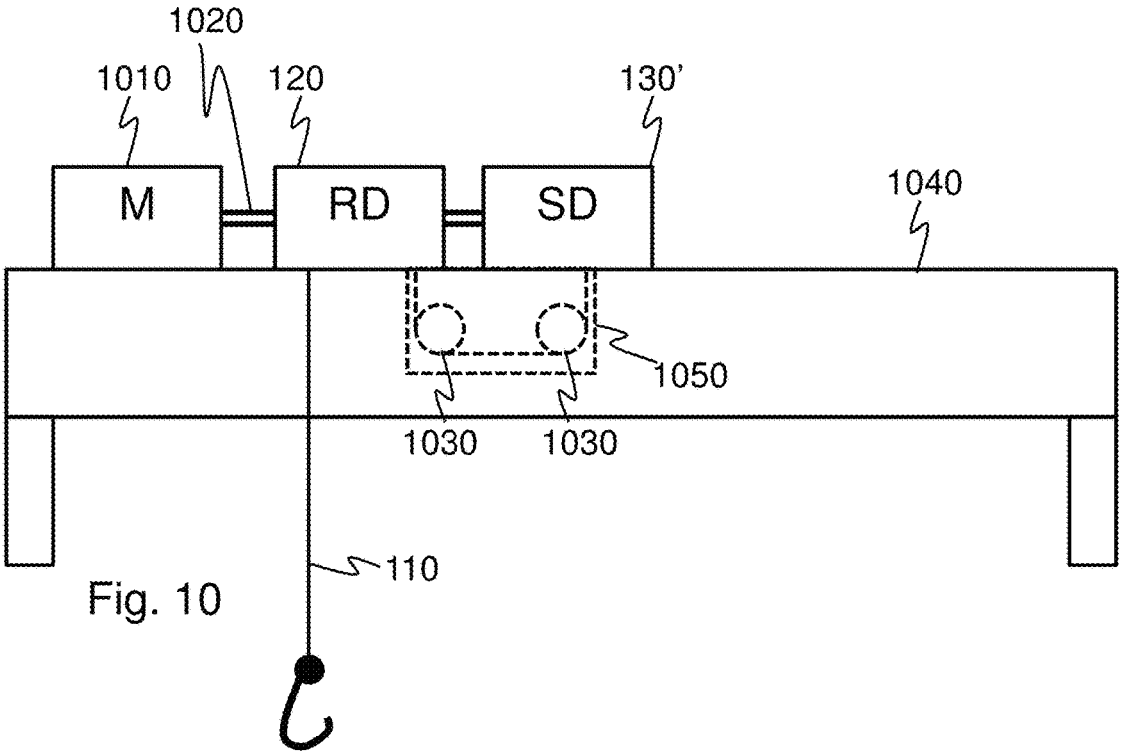
FIG. 10 presents a system in accordance with an embodiment of the present disclosure.

FIG. 10 presents equipment in accordance with an embodiment of the invention, which comprises an engine 1010, a rope drum 120 and a rope storage 130 to store the rope pulled in. The rope storage may comprise a storage drum.

The storage drum may be engine-driven. The engine drive may be equipped with momentum control or momentum limitation. The storage drum may be arranged to be used by a joint drive with the drum part, such as in FIG. 10. The storage drum and the drum part may be arranged to rotate driven by a joint axis 1020. The equipment may comprise one or several rope pulleys 1030, a crane frame 1040 and an auxiliary frame 1050 for supporting the rope pulleys 1030 to the frame of the crane 1040. In FIG. 10, the auxiliary frame and the rope pulleys are drawn downwards to make the drawing simpler; in some embodiments any parts directed outwards from the rope drum and/or the storage drum are guided to the side so that it is not necessary to restrict the lifting height or lateral movement of the crane.

The rope drum and the storage drum are preferably controlled by a frequency converter. In accordance with an embodiment, the rope drum and the storage drum are controlled by separate frequency converters. The guidance of the storage drum may be tightness-controlled or momentum-controlled.

The storage drum may comprise a spring-operated tightness adjustment. The tightness adjustment may be arranged to maintain a suitable tension in the rope part between the storage drum and the rope drum regardless of the effective radius of the storage drum.

Instead of storage, the rope may be run freely back to a hook, i.e. an endless loop may be implemented where there is a hook at some point. In this way, storage is not needed.

The effective radius may refer to the distance between the center point of the rope section wound on the storage drum and the rotation axis of the storage drum.

The drawing and release of the rope on the rope drum and storage on the storage drum may enable the implementation of a light, strong, space-effective system that is extensively suitable for different uses. The separation of the storage drum from the tension of the rope caused by a load by means of the rope drum enables multi-layered storage without unreasonable wear of the rope. Thanks to the separate rope storage, the equipment can be easily adapted to ropes of different lengths without the need to change the rope drum implementing the processing of the load, the use of the rope drum, the gearing, or the support structures.

The rope storage may be arranged to maintain a minimum tightness on the exit side of the rope drum. A minimum tightness may be a tightness that with sufficient certainty prevents the sliding of the rope on the drum part along the guide segments. A tightness preventing sliding with sufficient certainty may be a tightness enabling the start of sliding multiplied by a certainty factor. The rope storage may be arranged to tighten the rope on the departure side of the rope drum by means of a spring, an engine and/or a weight.

The equipment may comprise a bridge crane. The bridge crane may comprise one main supporter. The bridge crane equipped with a rope drum in accordance with an embodiment of the invention may be implemented with a sufficiently short rope drum to be held by one main supporter, even though in accordance with prior art two main supporters would be needed due to the length of the rope or the support of the rope drum required by the lifting capacity. Alternatively, the equipment may comprise a cantilever crane, an elevator mechanism or a winch.

Figure 11:
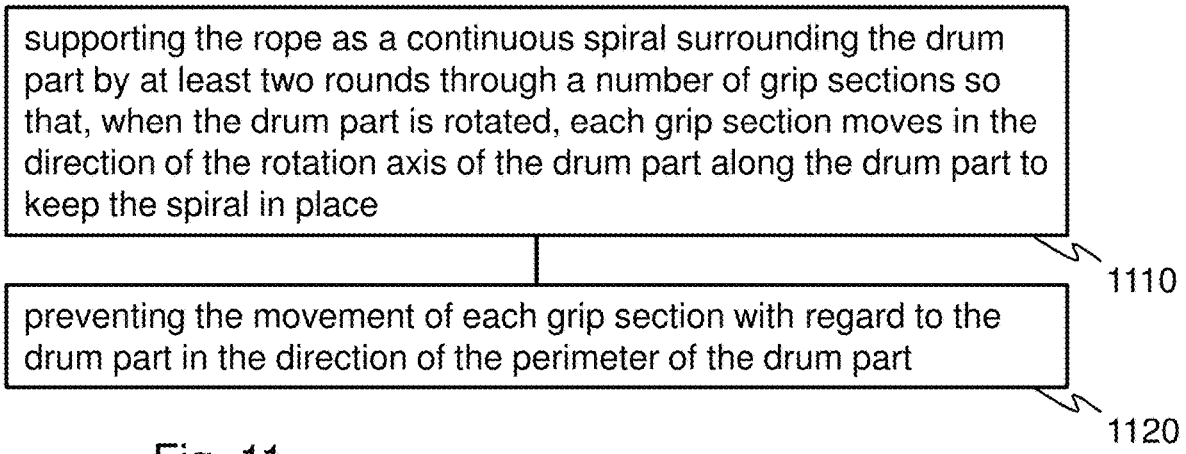
FIG. 11 presents a block diagram of a method in accordance with an embodiment of the present disclosure.

FIG. 11 presents a method in accordance with an embodiment of the invention, where a rope 1110 is supported as a continuous spiral surrounding the rope drum by at least two rounds through several grip sections so that, when the drum is rotated, each grip section moves in the direction of the rotation axis of the drum along the drum to keep the spiral in place, and the movement of each grip section with regard to the drum is prevented 1120 in the direction of the perimeter of the drum.

Figure 16A:
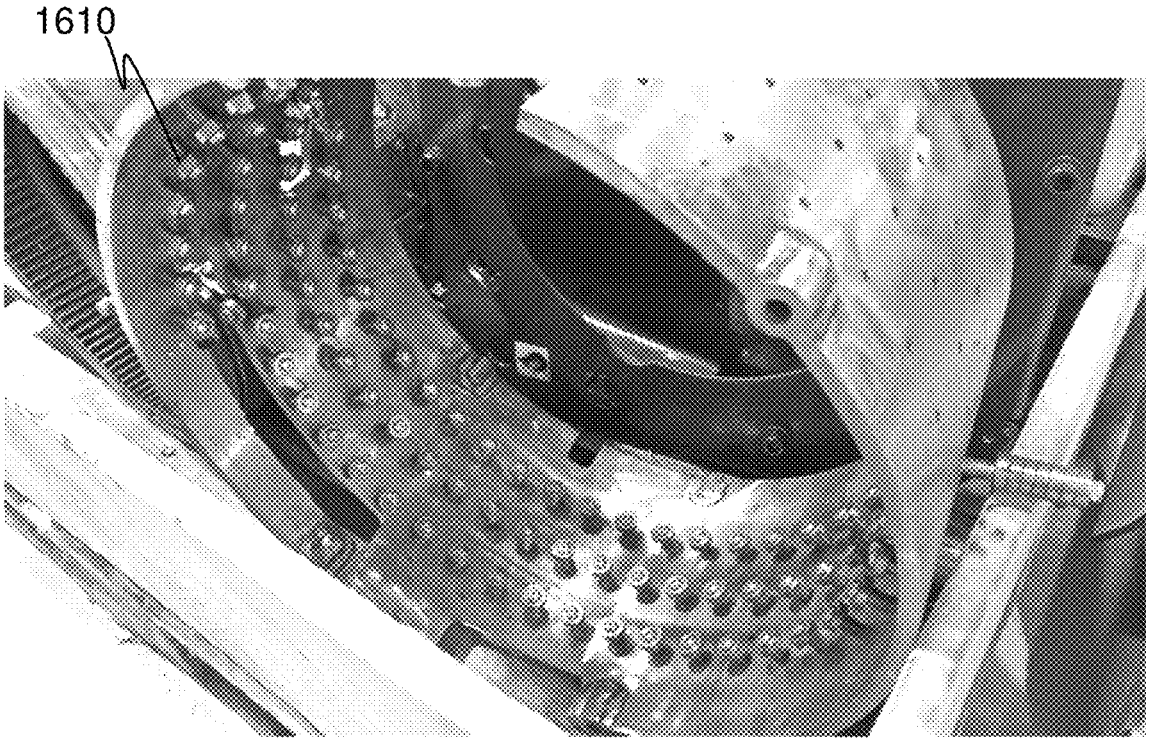
FIGS. 16*a* and 16*b* present a guide in accordance with an embodiment of the present disclosure which comprises a set of bearing rolls.
Figure 16B:
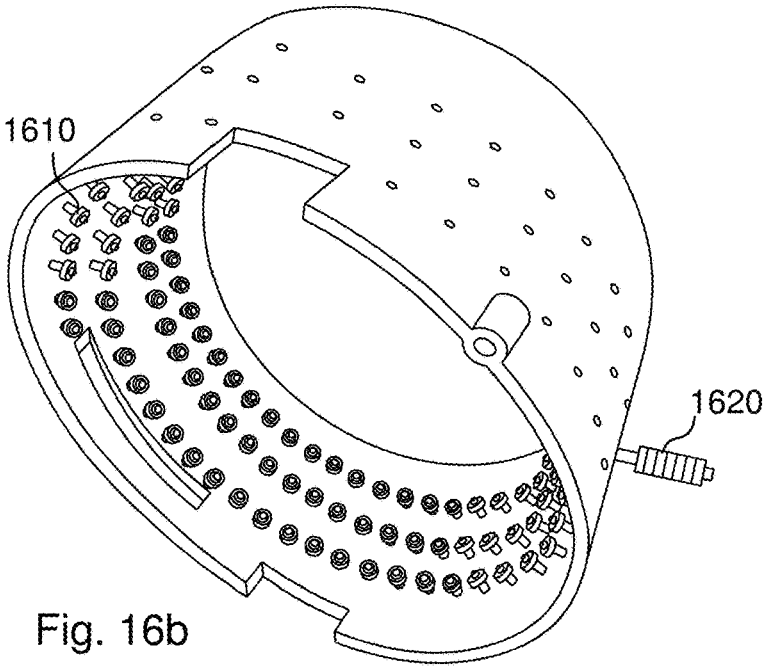

FIGS. 16*a* and 16*b* present a guide in accordance with an embodiment of the invention that comprises a set of bearing rolls 1610. The bearing rolls may be arranged to form a series of bearing rolls to guide the guide segments by the sides of the guide segments as a spiral along the drum part. The bearing rolls are located so densely that the guide segments receive a reliable guide surface on the rope drum from the side contact to the bearing rolls. The bearing rolls in FIG. 16 are so dense that on the drum part each guide segment is simultaneously touched by at least two bearing rolls on one side, excluding the guide segments entering the drum part and the guide segments leaving the drum part.

The bearing rolls 1610 or the elements corresponding to them may also be used in a situation in which, for the purpose of the return circulation of the guide segments, a protruding peg 1620 is arranged outside a shell which comprises one or several bearing rolls. The peg that has rolling surfaces provides a sideways guiding support for supporting the return circulation.

The rope drum may comprise a first bearing at the first end of the rope drum and a second bearing at the second end of the rope drum. The first bearing may be a bearing carrying axial forces, such as a ball bearing. The second bearing may be a bearing carrying radial forces, such as a roller bearing. The second bearing may be a floating bearing. By using at the first end a bearing that carries axial forces, it is possible to improve the robustness of the bearing of the rope drum, even though the axial forces caused by the guidance of the guide segments are slight compared to the load carried by the rope drum.

Figure 17:
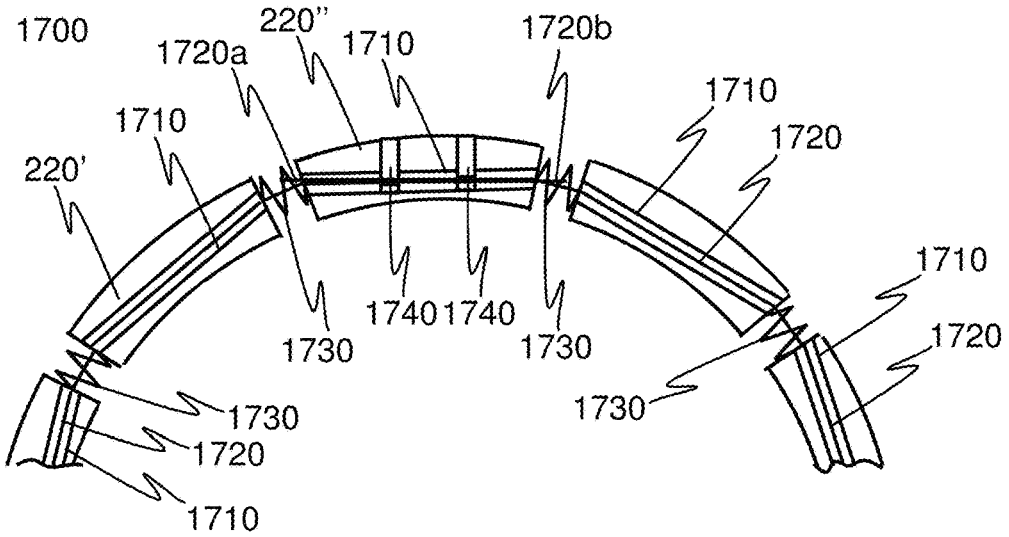
FIG. 17 presents a linking of guide segments in accordance with an embodiment of the present disclosure.

FIG. 17 presents a linking 1700 in accordance with an embodiment of the invention. The linking 1700 of the guide segments comprises a tie 1720 joining a number of guide segments, with regard to which the guide segments 220' are arranged to settle separately from each other through flexible separators 1730 at a desired distance or tolerance. By using similar separators as to their spring force, the guide segments 220' may be made to settle at similar distances from each other. The guide segments 220' in FIG. 17 may be similar to the guide segments 220 presented in FIGS. 6-8, excluding the characteristics related to linking, or other kinds of guide segments. In FIG. 17, the linking 1700 joining a number of guide segments 220' comprises a tie 1720 threaded through channels 1710 leading through a number of guide segments 220' (or a tie supported otherwise slidingly with regard to the guide segments, for example, a tie 1720 settled in grooves formed on both sides of the guide segments, or two or several wires or a chain). Using more than one parallel part in the implementation of the tie 1720 reduces the tendency of the chain to twist. More than one part in the tie is preferably arranged at mutually the same distance from the rotation center. These more than one part may be arranged to proceed to the guide segment settled around the drum part in the form of a circular arch or a polygon. The tie 1720 is, for example, one or several wires, a thread, a fibrous strand or a chain. The tie may be coated by, for example, plastic to reduce wear. The flexible separators 1730 may comprise, for example, springs, magnets, elastically compressible polymer pieces, and/or gel bags. The linking of the guide segments may comprise a guide segment adapted for the adjustment of the length of the tie, i.e. an adjustment segment 220". The tie may extend through all other guide segments 220' except the adjustment segment or, alternatively, the guide segments 220' may be joined as a number of different partial chains to each other so that the chain has more than one adjustment segment 220", in some embodiments only adjustment segments 220' are used in the chain. The flexible separators 1730 may be omitted between the adjacent adjustment segments 220' if the adjustment segments are locked to the tie 1720.

The adjustment segment 220" adapted for the adjustment of the length of the tie comprises a tie lock 1740 or a number of tie locks 1740 for locking the tie at the desired section to the adjustment segment. The tie lock may comprise, for example, a screw, a wedge, a lock pin and/or a soldered joint. In the adjustment segment 220" in FIG. 17, the ends of the tie 1720 1720*a*, 1720*b* are brought from opposite ends through the adjustment segment, but the adjustment segment may likewise be implemented in a number of other ways. For example, the ends 1720*a*, 1720*b* of the tie 1720 may be left inside the adjustment segment 220" or its own channel may be made in the adjustment segment to lead at least the other end 1720*a* outside the adjustment segment to overcome the force caused by the flexible separators 1730. In some cases, one end 1720*a* of the tie 1720 is joined to the adjustment segment in a fixed manner or otherwise in a non-adjustable manner.

In FIG. 17, the tie 1720 is drawn to proceed on a straight track inside the guide segments 220' and the adjustment segment. Alternatively, the tie 1720 is arranged to proceed on a curved route, for example, using the radius of curvature determined on the basis of the drum part so that the curvature of the tie 1720 does not change between the guide segments 220' compared to what the tie is at the distance of the guide segments. The guide segments are preferably returned from one end of the drum part to the other by a guide that is arranged to maintain the curvature of the tie as unchanged as possible. The flexible separators 1730 and the tolerance between the guide segments 220' facilitate the management of the position of the guide segments during this return.

Figure 18:
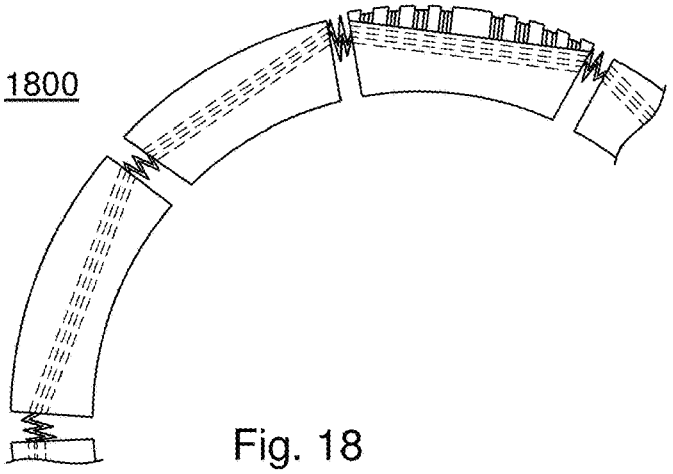
FIG. 18 presents an example where an optional linking is drawn.

FIG. 18 shows an example where an optional linking 1800 is drawn. In the linking of FIG. 18, the ends of the tie may also be left inside the adjustment segment, as drawn in FIG. 18, or they can be brought through the ends of the adjustment segment to make it easier to tighten the tie.

The above detailed description provides unlimited examples of some embodiments of the invention. It is clear to a person skilled in the art that the invention is not restricted to the details presented, but the invention may also be implemented in other equivalent ways. For example, the spiral may comprise portions closer to the direction of the perimeter, for example, at the length of the first half round from the receipt of the rope. As another example, to enable or restrict the movement of the guide segments it is possible to use means for guiding the guide segments (such as a cylinder or a cylindrical surface) which leave the rope round open from the outside (as, for example, in FIGS. 1, 2*a*, 2*b*, 3, 4, 5) or close the rope round within for the majority of the spiral (for example, in FIGS. 16*a*, 16*b*).

By means of the above presented embodiments, it is possible to form an entirety through which the momentum on the axis of the rope drum can be conveyed via the first supports and the guide segments to the rope carrying the load. Correspondingly, the force in the rope can be transferred by means of the whole to the momentum of the rope drum.

Some characteristics of the embodiments presented may be utilized without using other characteristics. The above presented detailed description must be considered, as such, only as a description describing the principles of the invention and not as limiting the invention. The scope of protection of the invention is only limited by the appended claims.

The invention claimed is:

1. A rope drum for a crane, elevator or winch capable of drawing in and releasing out a rope under tensile stress, which rope drum comprises:

a rotatable drum part;

support means configured to provide a number of grip sections for supporting the rope through the grip sections as a continuous spiral surrounding the drum part by at least two rounds so that, when the drum part is rotated, the number of grip sections move due to guidance of the support means along the drum part depending on rotating direction of the drum part towards a first end of the drum part or a second end; and prevention means that together with the support means are configured to restrict the movement of the grip sections supporting the rope on the drum part with regard to the drum part in the direction of a perimeter to a maximum that is defined by a mutual geometry of the prevention means and the support means;

wherein the prevention means comprise a number of substantially axial first supports in the direction of the perimeter of a shell of the drum part separately from each other;

the support means comprise a number of guide segments; wherein the first supports deviate from the direction of the rotation axis of the rope drum by at most 10°; and the first supports are configured to function as part of the prevention means only after the guide segment has settled on the rope drum and after a start section of the spiral.

2. The rope drum according to claim 1, wherein the first supports are formed to function as part of the prevention means only after the guide segment has settled on the drum part after a length of 0.1; 0.2; 0.3; 0.4; 0.5; 0.6; 0.7; 0.8; 0.9; or 1.0 rounds of the drum part.

3. The rope drum according to claim 1, wherein the first supports have an asymmetric profile as to their cross-section.

4. The rope drum according to claim 1, wherein the guide segments comprise a first form locking part, which forms a part of the prevention means.

5. The rope drum according to claim 1, wherein the guide segments are configured to settle against an outer surface of the drum part at least in a part of a perimeter of the drum part.

6. The rope drum according to claim 5, wherein the guide comprises a shell surrounding the rope drum, where a guide groove is formed, which is arranged to guide the guide segments along a desired track.

7. The rope drum according to claim 5, wherein the guide comprises a shell surrounding the rope drum, to which shell bearing rolls are fastened to guide the guide segments along a desired track.

8. The rope drum according to claim 5, wherein the guide comprises means for guiding the guide segments as a spiral by pushing from the direction of ends of the rope drum towards a middle of the rope drum.

9. The rope drum according to claim 8, wherein the chain comprises flexible links that connect the consecutive guide segments.

10. The rope drum according to claim 8, wherein the chain comprises a tie that connects a number of consecutive guide segments.

11. The rope drum according to claim 10, wherein at least one guide segment of the number of guide segments is configured to be capable of adjusting the length of the tie.

12. The rope drum according to claim 1, wherein the guide segments form a rope groove for receiving the rope and for gripping the rope with friction.

13. The rope drum according to claim 12, wherein the guide comprises a shell surrounding the rope drum, where a guide groove is formed, which is arranged to guide the guide segments along a desired track; and the guide groove and the guide segments are arranged to allow the movement of the guide segments in the direction of the guide groove when the drum part rotates, but to prevent the exit of the guide segments from the guide groove between end points of the spiral.

14. The rope drum according to claim 1, wherein the rope drum comprises a guide for guiding the guide segments to form said spiral from the rope around the rope drum on top of the guide segments.

15. The rope drum according to claim 1, wherein the guide segments are joined as a chain.

16. The rope drum according to claim 1, wherein the rope drum is mounted on a bearing at its one end to be axially carrying and mounted floatingly at its second end with regard to axial forces.

17. Equipment, wherein the equipment comprises a rope drum according to claim 1 and a rope storage for storing the rope pulled in.

18. The equipment according to claim 17, wherein the rope storage is arranged to maintain a minimum tightness preventing the sliding taking place on the drum part on the exit side of the rope drum.

19. The equipment according to claim 17, wherein the equipment comprises a functioning bridge crane held by one main supporter.

20. A method for drawing in or releasing a rope out under tensile stress by means of a rope drum of a crane, elevator or winch, supporting the rope by means of a number of grip sections as a continuous spiral surrounding a drum part by at least two rounds so that, when the drum part is rotated, a number of grip sections move along the drum part depending on the rotation direction of the drum part towards the first end of the drum part or towards a second end; and restricting the movement of the grip sections supporting the rope on the drum part with regard to the drum part in the direction of the perimeter to a maximum that is defined by the mutual geometry of a prevention means and a support means;

wherein the prevention means comprise a number of substantially axial first supports in the direction of the perimeter of a shell of the drum part separately from each other; and the support means comprise a number of guide segments;

wherein the first supports deviate from the direction of the rotation axis of the rope drum by at most 10°; and functioning by the first supports as part of the prevention means only after the guide segment has settled on the rope drum and after a start section of the spiral.

* * * * *